US007845322B2

(12) United States Patent
Dunsch et al.

(10) Patent No.: US 7,845,322 B2
(45) Date of Patent: Dec. 7, 2010

(54) CYLINDER HEAD COVER

(75) Inventors: Robert Dunsch, Vaihingen (DE); Stefan Ruppel, Heidelberg-Emmertsgrund (DE); Torsten Schellhase, Vaihingen (DE)

(73) Assignee: Mahle International GmbH (DE)

( * ) Notice: Subject to any disclaimer, the term of this patent is extended or adjusted under 35 U.S.C. 154(b) by 77 days.

(21) Appl. No.: 12/129,298

(22) Filed: May 29, 2008

(65) Prior Publication Data

US 2008/0295796 A1 Dec. 4, 2008

(30) Foreign Application Priority Data

May 30, 2007 (DE) ..... 10 2007 025 129

(51) Int. Cl.
*F01M 9/10* (2006.01)
*F02F 1/42* (2006.01)

(52) U.S. Cl. ..... 123/90.38; 123/90.27; 123/193.5

(58) Field of Classification Search ..... 123/195 C, 123/90.27, 90.34, 193.5, 90.38
See application file for complete search history.

(56) References Cited

U.S. PATENT DOCUMENTS

| | | | | |
|---|---|---|---|---|
| 1,631,410 | A * | 6/1927 | Fornaca | 123/90.22 |
| 5,070,824 | A * | 12/1991 | Morishita | 123/41.82 R |
| 5,987,973 | A * | 11/1999 | Fujii et al. | 73/114.28 |
| 6,148,787 | A * | 11/2000 | Takano | 123/195 A |
| 6,257,188 | B1 | 7/2001 | Fujii et al. | |
| 2003/0094155 | A1 | 5/2003 | Shimoyama et al. | |

FOREIGN PATENT DOCUMENTS

| | | | |
|---|---|---|---|
| DE | 3603938 A | * | 8/1987 |
| DE | 4017048 A | * | 11/1991 |
| DE | 4017048 A1 | | 11/1991 |
| DE | 43 23 073 | | 1/1995 |
| DE | 43 24 791 | | 1/1995 |
| DE | 196 03 692 | | 8/1997 |
| DE | 19603692 A1 | | 8/1997 |
| DE | 198 53 537 | | 5/2000 |

(Continued)

OTHER PUBLICATIONS

English abstract provided for DE-102005028332.

(Continued)

*Primary Examiner*—Noah Kamen
(74) *Attorney, Agent, or Firm*—Rader, Fishman & Grauer PLLC

(57) ABSTRACT

The present invention relates to a cylinder head cover (4) for covering a cylinder crank case (14) of an internal combustion engine. It is essential to the invention here that at least one bearing upper part (3) for a camshaft (2) has at least one through-opening (5), which is in alignment on the one hand with a screw-in/through-opening (5*a*) in a bearing lower part (6) and/or with a screw-in opening (5*b*) in the cylinder crank case (14) and on the other hand with a through-opening (5*c*) in the cylinder head cover (4), so that it is possible to fasten the cylinder head cover (4) and the bearing upper part (3) on the cylinder crank case (14) by means of a shared fastening screw (7), in which the cylinder head cover (4) is produced from a material which has different material characteristics from the at least one bearing upper part (3).

18 Claims, 3 Drawing Sheets

FOREIGN PATENT DOCUMENTS

Figure 1:
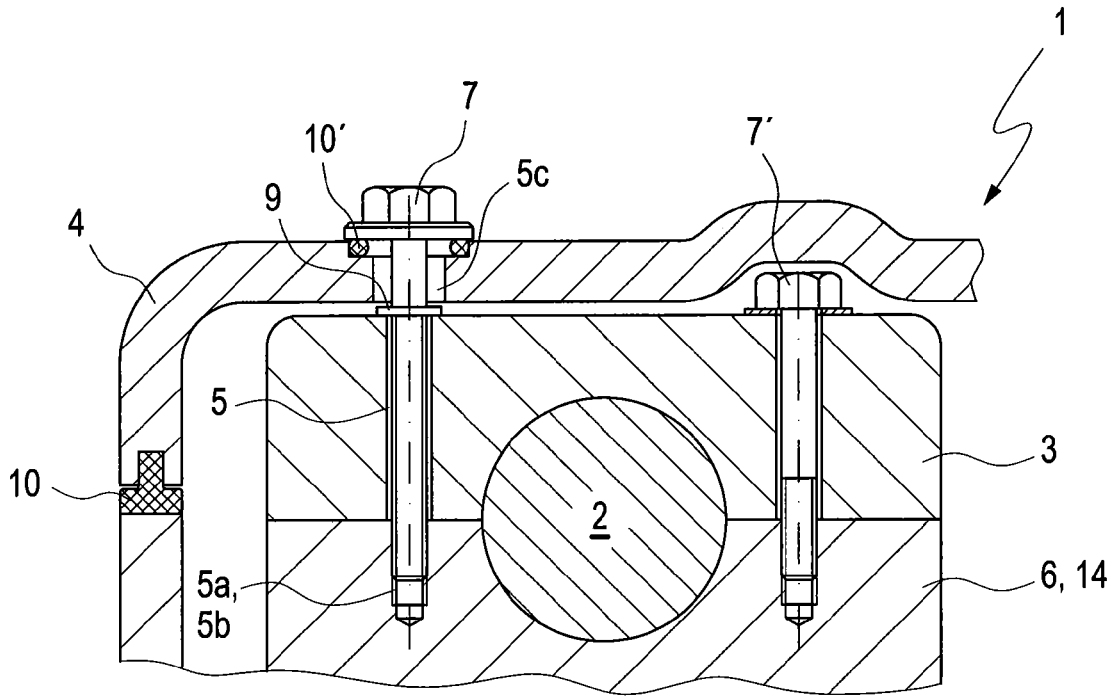

| | | | | |
|---|---|---|---|---|
| DE | 201 20 912 | | | 7/2002 |
| DE | 10332648 | A1 | | 2/2005 |
| DE | 10 2005 028 331 | | | 12/2006 |
| DE | 102005028332 | A1 | | 1/2007 |
| DE | 102005030914 | A1 | | 1/2007 |
| DE | 20 2005 013 879 | | | 2/2007 |
| EP | 1312772 | A1 | | 5/2003 |
| EP | 1 312 771 | | | 2/2005 |
| JP | 2000045742 | A | * | 2/2000 |

OTHER PUBLICATIONS

English abstract provided for DE-102005030914.
English abstract provided for DE-10332648.
English abstract provided for DE-19603692.
English Abstract for DE 43 24 791.
English Abstract for DE 43 23 073.
English Abstract for DE 10 2005 028 331.
English Abstract for DE 196 03 692.
English Abstract for DE 198 53 537.
English Abstract for EP 1 312 771.

* cited by examiner

CYLINDER HEAD COVER

CROSS-REFERENCE TO RELATED APPLICATION

This application claims priority from German Patent Application No. DE 10 2007 025 129.9, filed 30 May 2007, which is hereby incorporated by reference in its entirety.

The present invention relates to a cylinder head cover for covering a cylinder crank case of an internal combustion engine according to the introductory clause of claim 1.

From DE 43 23 073 A1 a cylinder head cover is known for covering a reciprocating piston internal combustion engine, in which bearing covers of the camshaft bearings are formed onto the cylinder head cover.

From DE 10 2005 028 332 A1 a cylinder head cover is known with integrated bearing upper parts of camshaft bearings, in which the bearing upper parts are connected with the cylinder head cover by means of damping material and in which the bearing upper parts are fastened to the cylinder head by screws.

From DE 201 20 912 U1 a cylinder head cover is known for a cylinder head, in which first bearing halves for all the camshaft bearings of a camshaft are formed integrally with the cylinder head cover. The second bearing halves are formed as separate parts and screwed onto the first bearing halves, in which a plane of separation between cylinder head and cylinder head cover is formed spaced apart from a plane of separation of the camshaft bearings.

Finally, from DE 198 53 537 A1 a cylinder head cover is known, into which likewise bearing upper parts for a camshaft bearing are integrated.

The present invention concerns the problem of indicating an improved embodiment for a generic cylinder head cover, which in particular facilitates a mounting of the cylinder head cover on the camshaft and at the same time ensures a reliable bearing of the camshaft.

This problem is solved according to the invention by the subject matter of the independent claim 1.

Advantageous embodiments are the subject matter of the sub-claims.

The invention is based on the general idea, with a cylinder head cover for covering a cylinder crank case, of coordinating the latter and at least one bearing upper part for a camshaft with each other so that these can be secured on the cylinder crank case with a shared fastening screw. In addition, the bearing upper part is to be produced from a material which, compared with the cylinder head cover, has different material characteristics, in particular better bearing characteristics. According to the invention, to do this the at least one bearing upper part has at least one through-opening which on the one hand is in alignment with a screw-in/through-opening in a bearing lower part and/or with a screw-in opening in the cylinder crank case and on the other hand with a through-opening in the cylinder head cover, so that the above-mentioned fastening of the cylinder head cover and of the bearing upper part is possible by means of a shared fastening screw. Through the different material characteristics of the at least one bearing upper part and of the cylinder head cover, the bearing upper part can be constructed so that it has particularly good bearing characteristics for the camshaft which is to be supported, whereas the cylinder head cover does not have to have these characteristics, so that a different material can be selected for this which is optimized specifically for its purpose of use. The cylinder head cover according to the invention thereby makes possible on the one hand a simplified mounting of the cylinder head cover on the camshaft, because this can be established together with the bearing upper part, and on the other hand it improves the bearing characteristics, because a special material, selected having particularly good bearing characteristics, is used for the bearing upper part.

Expediently, detent brackets are arranged on the cylinder head cover, which make possible an engagement of the at least one bearing upper part on the cylinder head cover. Such detent brackets play a part in particular in a bearing upper part which is constructed as a separate component from the cylinder head cover. In this case, the at least one bearing upper part can be engaged simply with the detent brackets which are provided on the cylinder head cover and hence can be placed without difficulty together with the cylinder head cover onto the cylinder crank case and screwed. It is also conceivable here that firstly the bearing upper part is screwed with the cylinder crank case and then the cylinder crank case is firstly engaged via the detent brackets with the at least one bearing upper part and thereby assumes a position which is already predefined for the final mounting. Generally, each of the bearing upper parts here can have a fastening screw which fastens exclusively the bearing upper part on the cylinder crank case or the bearing upper part together with the cylinder head cover.

Expediently, the cylinder head cover is formed from a thermoplastic plastic, whereas the bearing upper part is formed from a duroplastic plastic. Thermoplasts are plastics which can be shaped in a simple manner, namely thermoplastically, in a particular temperature range. The process here is reversible. Hereby, it is possible to produce the cylinder head cover by injection moulding. By comparison, duroplasts are plastics which can not be shaped again after they have hardened. Duroplasts therefore maintain stability of shape even at higher temperatures, which is particularly advantageous for the construction of the bearing upper parts. Furthermore, it is possible to form duroplasts having different characteristics, in particular with a high chemical resistance, whereby a usage is possible in a camshaft chamber which is acted upon by partially aggressive motor oils.

In a further advantageous embodiment of the solution according to the invention, a bearing lower part for the camshaft is formed from a duroplastic plastic, in which the bearing lower part and the bearing upper part can be formed as separate components or in a single piece. In particular in the latter variant, it is possible to inject the bearing lower part and the bearing upper part in an injection process around the camshaft, whereby particularly good bearing characteristics can be achieved. However, it is also conceivable that the two bearing parts, as mentioned above, are constructed as separate components and accordingly can be secured on the cylinder crank case by means of a shared fastening screw together with the cylinder head cover.

Further important features and advantages of the invention will be apparent from the sub-claims, from the drawings and from the associated description of the figures with the aid of the drawings.

It is to be understood that the features which are mentioned above and which are to be further explained below are able to be used not only in the respectively indicated combination, but also in other combinations or on their own, without departing from the framework of the present invention.

Preferred example embodiments of the invention are illustrated in the drawings and are explained in further detail in the following description, in which the same reference numbers refer to the same or similar or functionally identical components.

Figure 2:
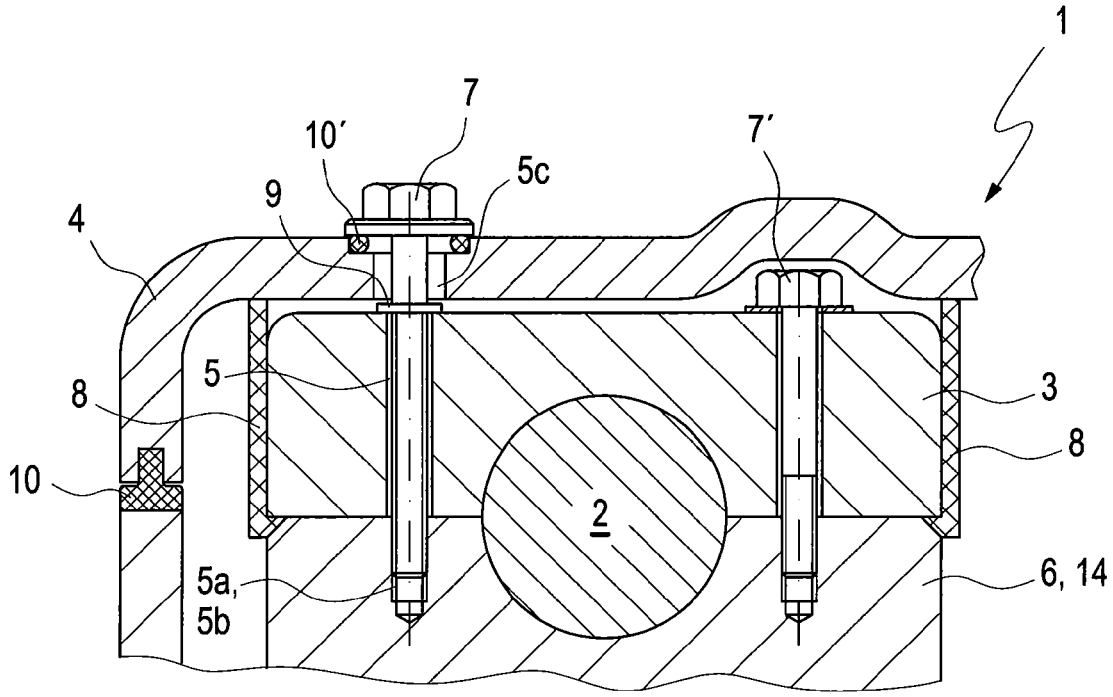
Figure 3:
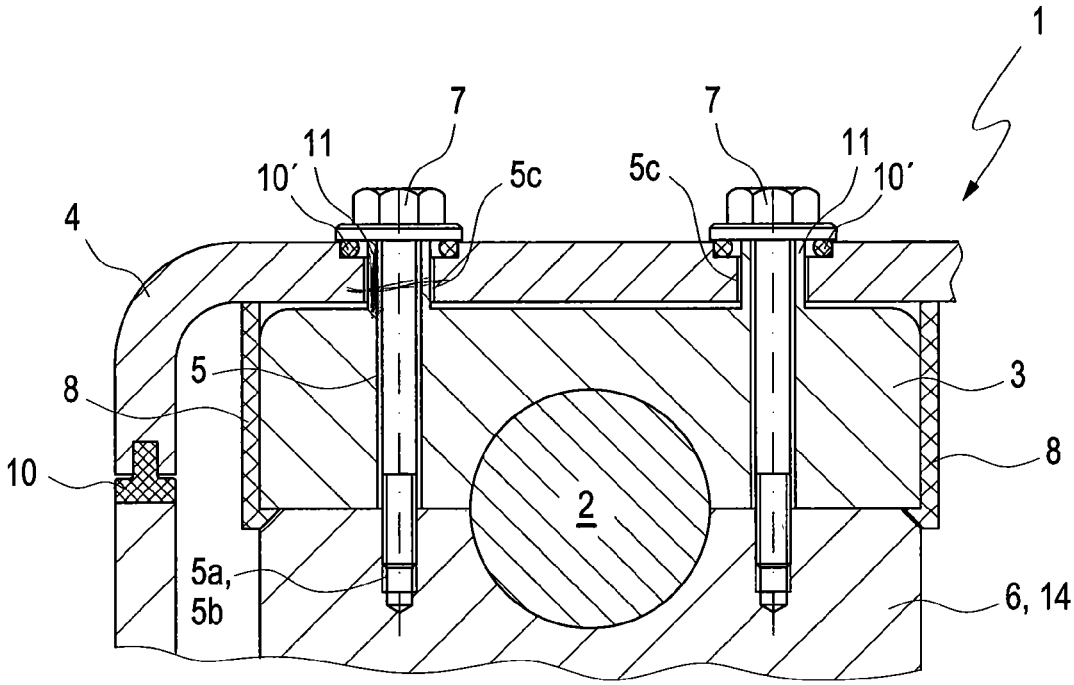
Figure 4:
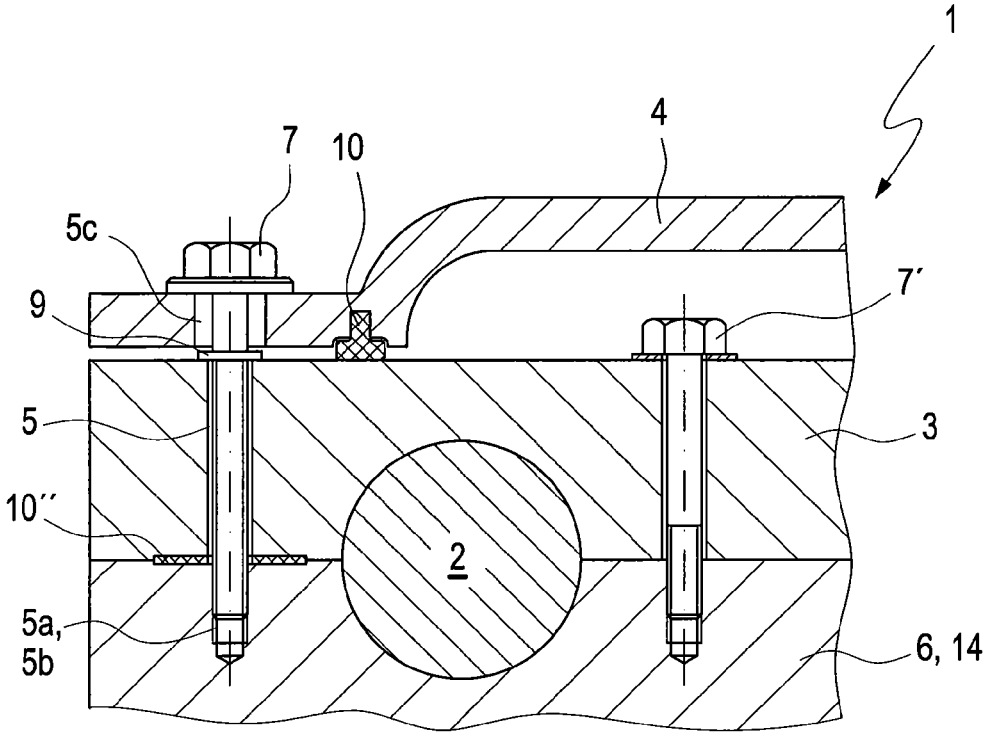
Figure 5:
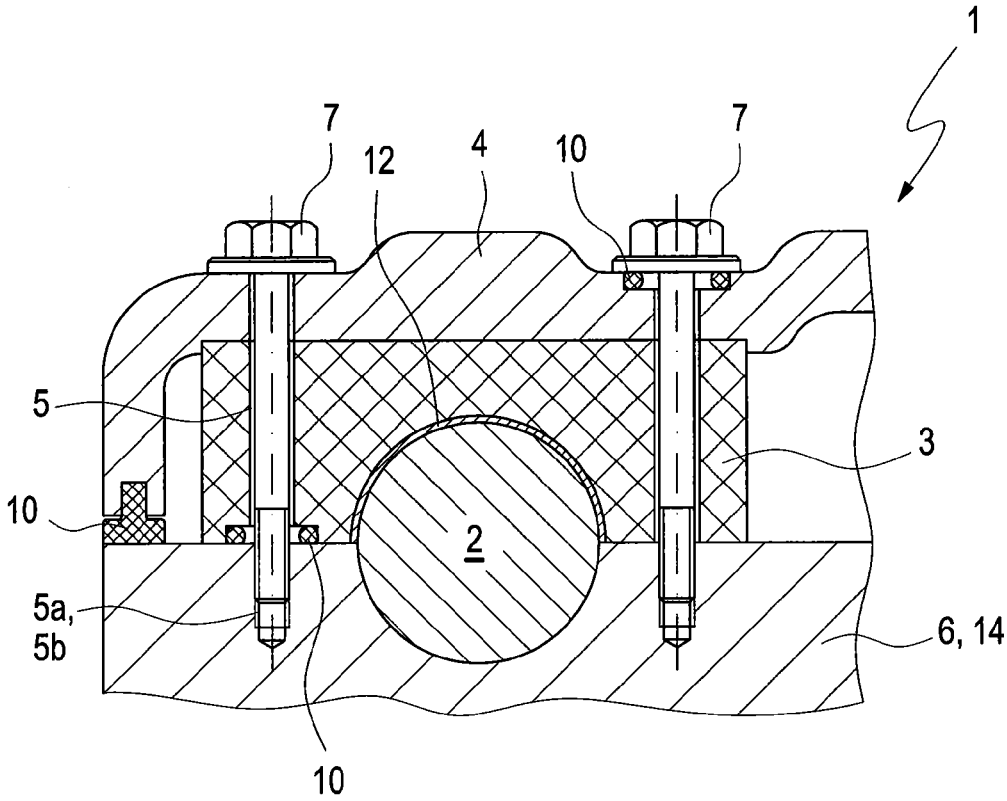
Figure 6:
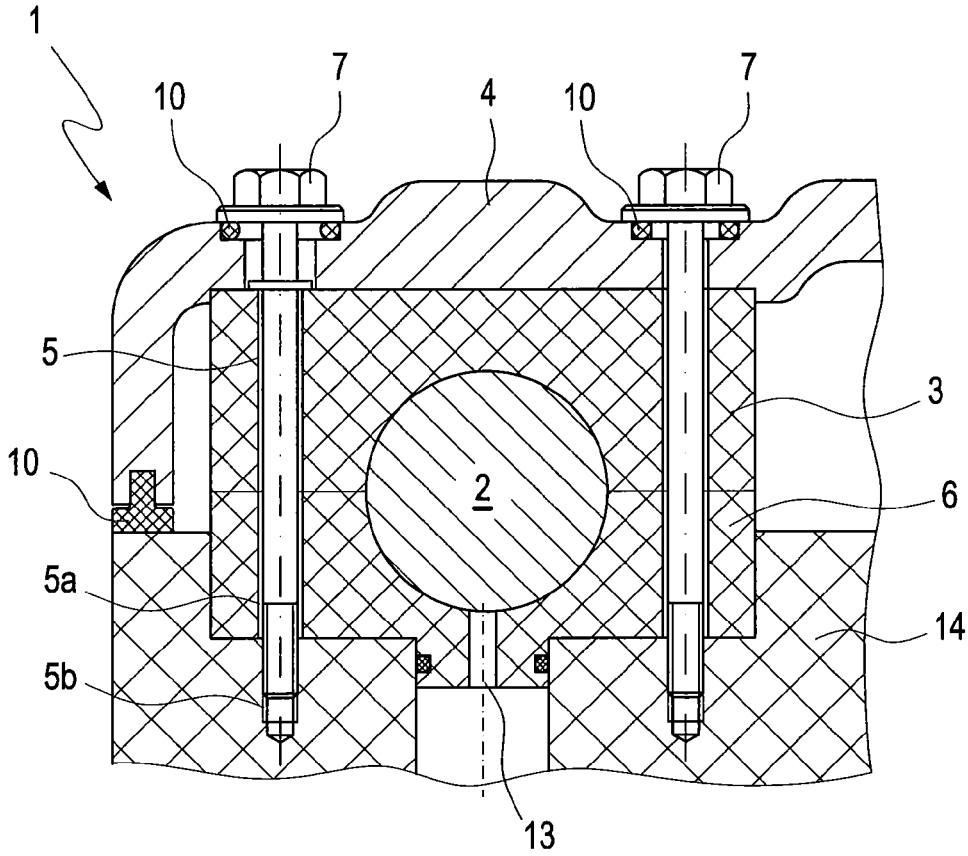

Diagrammatically, in each case,

FIG. 1 shows a first embodiment of a cylinder head cover according to the invention, FIG. 2 shows an illustration as in FIG. 1, but with detent brackets formed on the cylinder head cover, FIG. 3 shows an illustration as in FIG. 2, but with another embodiment, FIG. 4 shows a cylinder head cover with a bearing upper part constructed as a bearing frame, FIG. 5 shows an illustration of a cylinder head cover with an injected-on bearing upper part, FIG. 6 shows an illustration with a bearing lower part, produced separately from the cylinder crank case, for the camshaft.

In accordance with FIGS. 1 to 6, a cylinder head 1 has a camshaft 2 mounted in a cylinder crank case 14, which camshaft 2 is supported at the top by means of at least one bearing upper part 3. The cylinder crank case 14 is covered by means of a cylinder head cover 4.

According to the invention, the at least one bearing upper part 3 has at least one through-opening 5 for the camshaft 2, which through-opening 5 is in alignment on the one hand with a screw-in/through-opening 5*a* in a bearing lower part 6 (cf. FIG. 6) and/or with a screw-in opening 5*b* in the cylinder crank case 14 and on the other hand with a through-opening 5*c* in the cylinder head cover 4. Hereby, it is possible to fasten the cylinder head cover 4 and the bearing upper part 3 on the cylinder crank case 14 by means of a shared fastening screw 7.

According to FIG. 1, the bearing upper part 3 can be additionally fastened here with a fastening screw 7' on the cylinder crank case 14 or on a bearing lower part 6, which does not serve for the simultaneous fastening of the cylinder head cover 4.

So as to be able, in addition, to coordinate the material characteristics of the bearing upper part 3 optimally with the bearing of the camshaft 2, the bearing upper part 3 is produced from a material which has different material characteristics from the cylinder cover 4.

By the shared fastening screw 7, separate fastening screws for fastening the cylinder head cover 4 on the cylinder crank case 14 can be dispensed with.

In FIG. 1 the at least one bearing upper part 3 is constructed as a separate component from the cylinder head cover 4, in which detent elements, in particular detent brackets 8, are arranged on the cylinder head cover 4, which make possible an engagement of the at least one bearing upper part 3 on the cylinder head cover 4. Hereby, it is possible for the bearing upper part 3 to be initially engaged via the detent brackets 8 with the cylinder head cover 4, and then for both to be placed together on the cylinder crank case 14 or onto the bearing lower part 6. It is also conceivable here that, as shown in FIG. 2, the bearing upper part 3 is firstly screwed by the screw 7' with the bearing lower part 6 or with the cylinder crank case 14, and then the cylinder head cover 4 is engaged by the detent brackets 8 with the bearing upper part 3, so that then the fastening screw 7 can be screwed through the cylinder head cover 4, the bearing upper part 3 into the bearing lower part 6 or into the cylinder crank case 14.

As illustrated in FIGS. 1 and 2, the fastening screw 7 is constructed as a collar screw and can have a collar 9 provided between the cylinder head cover 4 and the bearing upper part 3. The cylinder head cover 4 is sealed here with respect to the cylinder crank case 14 by a seal 10 running along a flange and by a seal 10' arranged between screw head and cylinder head cover 4.

According to FIG. 3, the at least one bearing upper part 3 has at least one sleeve extension 11 in alignment with the through-opening 5*c* in the cylinder head cover 4, which extension 11, in the case of the mounted cylinder head cover 4, engages into the through-opening 5*c* of the cylinder head cover 4 and forms a stop for a screw head of the fastening screw 7. Hereby, it is made possible that a tightening action of the fastening screw 7 does not act indirectly via the cylinder head cover 4 onto the bearing upper part 3, but rather directly via the sleeve extension 11 onto the bearing upper part 3. As shown in FIG. 3, compared with FIG. 2, two fastening screws 7 can also be provided, which cross both the cylinder head cover 4 and also the bearing upper part 3. The detent brackets 8 according to FIGS. 2 and 3 can be injected here onto the cylinder head cover 4.

According to FIG. 4, an embodiment of the cylinder head 1 according to the invention is shown in which the bearing upper part 3 is constructed as a bearing frame. Here, a seal 10" is also provided between the bearing upper part 3 and the cylinder crank case 14.

According to FIG. 5, the bearing upper part 3 is formed in one piece with the cylinder head cover 4, in which provision can be made that the cylinder head cover 4 is formed from a thermoplastic plastic and the bearing upper part 3 is formed from a duroplastic plastic. The specific advantages of the individual types of plastic have already been mentioned in the introduction to the description. It is conceivable here that the bearing upper part 3 is injected onto the cylinder head cover 4 and optionally, furthermore, a bearing box 12, in particular of aluminium, which is let into the bearing upper part 3, can be provided.

Compared with FIG. 5, the bearing lower part 6 in FIG. 6 is also formed from plastic, in particular from duroplastic plastic, in which the bearing lower part 6 and the bearing upper part 3 can either be formed as separate components or in a single piece. With a construction of the two bearing parts 3 and 6 in a single piece, the camshaft 2 is therefore injected around completely. The bearing composed of the two bearing parts 3 and 6 can either be formed here again separately from the cylinder head cover 4 or in a single piece, in particular injected thereon. Preferably, the lower bearing part 6 has an oil feed duct 13 here to supply the camshaft bearing with lubricant. In the illustration according to FIG. 5, distinctly more seals 10 are necessary compared with the previous figures.

In FIGS. 5 and 6, the cylinder head cover 4 or the associated bearing upper part 3 and/or the bearing lower part 6, is therefore constructed as a hybrid component of at least two different materials. In particular the bearing shown according to FIG. 6, which consists of the cohesive bearing lower part 6 and the associated bearing upper part 3, offers the great advantage of injecting around the camshaft 2 completely and of entirely dispensing with the processing of a camshaft bearing.

By the fastening screws 7 with which not only the bearing upper part 3 is fastened on the cylinder crank case 14 or on a bearing upper part 6, but at the same time also the cylinder head cover 4, a saving can be made with regard to some fastening screws 7', which leads on the one hand to a reduction in the multiplicity of parts and on the other hand to a reduction in the costs and the weight.

The invention claimed is:

1. A cylinder head cover assembly, comprising:

at least one bearing upper part for a camshaft, the bearing upper part defining at least one passage extending through the at least one bearing upper part, the passage being in alignment with a first opening in one of a bearing lower part and a cylinder crank case; and a cylinder head cover defining a second opening, the second opening aligned with the passage such that the cylinder head cover and the bearing upper part can be fastened on the one of the bearing lower part and the cylinder crank case with a shared fastener;

wherein the cylinder head cover includes at least one detent element, the detent element configured to engage the cylinder head cover with the bearing upper part, and wherein the cylinder head cover is formed of a first material and the at least one bearing upper part is formed of a second material, the first material having a different material characteristic than the second material.

2. The cylinder head cover assembly according to claim 1, wherein the at least one bearing upper part is formed as a separate component from the cylinder head cover.

3. The cylinder head cover assembly according to claim 1, wherein the at least one bearing upper part is a bearing frame.

4. The cylinder head cover assembly according to claim 1, wherein the cylinder head cover is formed from a thermoplastic material and the bearing upper part is formed from a duroplastic material.

5. The cylinder head cover assembly according to claim 1, wherein the bearing lower part includes an oil duct.

6. The cylinder head cover assembly according to claim 1, wherein the at least one bearing upper part has at least one sleeve extension in alignment with the second opening, the at least one sleeve extension extending into the second opening of the cylinder head cover, thereby forming the stop shared fastener.

7. A cylinder head cover assembly, comprising:

at least one bearing upper part for a camshaft, the bearing upper part defining at least one passage extending through the at least one bearing upper part, the passage being in alignment with a first opening in one of a bearing lower part and a cylinder crank case; and a cylinder head cover defining a second opening, the second opening aligned with the passage such that the cylinder head cover and the bearing upper part can be fastened on the one of the bearing lower part and the cylinder crank case with a shared fastener;

wherein the bearing upper part is formed in a single piece with the cylinder head cover, and wherein the cylinder head cover is formed of a first material and the at least one bearing upper part is formed of a second material, the first material having a different material characteristic than the second material.

8. The cylinder head cover assembly according to claim 7, wherein the cylinder head cover includes at least one detent element, the detent element configured to engage the cylinder head cover with the bearing upper part.

9. The cylinder head cover assembly according to claim 7, wherein the at least one bearing upper part has at least one sleeve extension in alignment with the second opening, the at least one sleeve extension extending into the second opening of the cylinder head cover, thereby forming the stop shared fastener.

10. The cylinder head cover assembly according to claim 7, wherein the cylinder head cover is formed from a thermoplastic material and the bearing upper part is formed from a duroplastic material.

11. A cylinder head cover assembly, comprising:

at least one bearing upper part for a camshaft, the bearing upper part defining at least one passage extending through the at least one bearing upper part, the passage being in alignment with a first opening in one of a bearing lower part and a cylinder crank case; and a cylinder head cover defining a second opening, the second opening aligned with the passage such that the cylinder head cover and the bearing upper part can be fastened on the one of the bearing lower part and the cylinder crank case with a shared fastener;

wherein the bearing lower part is formed from a duroplastic material, and the bearing lower part and the bearing upper part are formed as one of separate components and a single piece, and wherein the cylinder head cover is formed of a first material and the at least one bearing upper part is formed of a second material, the first material having a different material characteristic than the second material.

12. The cylinder head cover assembly according to claim 11, wherein the at least one bearing upper part is formed as a separate component from the cylinder head cover.

13. The cylinder head cover assembly according to claim 11, wherein the cylinder head cover includes at least one detent element, the detent element configured to engage the cylinder head cover with the bearing upper part.

14. The cylinder head cover assembly according to claim 11, wherein the at least one bearing upper part has at least one sleeve extension in alignment with the second opening, the at least one sleeve extension extending into the second opening of the cylinder head cover, thereby forming the stop shared fastener.

15. An internal combustion engine comprising:

at least one bearing upper part for a camshaft, the bearing upper part defining at least one passage extending through the at least one bearing upper part, the passage being in alignment with a first opening in one of a bearing lower part and a cylinder crank case; and a cylinder head cover defining a second opening, the second opening aligned with the passage such that the cylinder head cover and the bearing upper part can be fastened on the one of the bearing lower part and the cylinder crank case with a stop shared fastener;

wherein the cylinder head cover is formed of a first material and the at least one bearing upper part is formed of a second material, the first material having a different material characteristic than the second material, and wherein the at least one bearing upper part has at least one sleeve extension in alignment with the second opening, the at least one sleeve extension extending into the second opening of the cylinder head cover, thereby forming the stop shared fastener.

16. The cylinder head cover assembly according to claim 15, wherein the at least one bearing upper part is formed as a separate component from the cylinder head cover.

17. The cylinder head cover assembly according to claim 15, wherein the cylinder head cover includes at least one detent element, the detent element configured to engage the cylinder head cover with the bearing upper part.

18. The cylinder head cover assembly according to claim 15, wherein the cylinder head cover is formed from a thermoplastic material and the bearing upper part is formed from a duroplastic material.

* * * * *